US007169283B2

(12) United States Patent
Yagi et al.

(10) Patent No.: US 7,169,283 B2
(45) **Date of Patent: *Jan. 30, 2007**

(54) ANODIZATION DEVICE AND ANODIZATION METHOD

(75) Inventors: Yasushi Yagi, Kanagawa (JP); Kazutsugu Aoki, Kanagawa (JP); Mitsuru Ushijima, Tokyo (JP)

(73) Assignee: Tokyo Electron Limited, Tokyo (JP)

( * ) Notice: Subject to any disclaimer, the term of this patent is extended or adjusted under 35 U.S.C. 154(b) by 470 days.

This patent is subject to a terminal disclaimer.

(21) Appl. No.: 10/471,574

(22) PCT Filed: Jan. 21, 2003

(86) PCT No.: PCT/JP03/00458

§ 371 (c)(1),
(2), (4) Date: Sep. 12, 2003

(87) PCT Pub. No.: WO03/062505

PCT Pub. Date: Jul. 31, 2003

(65) Prior Publication Data

US 2004/0089552 A1 May 13, 2004

(30) Foreign Application Priority Data

Jan. 21, 2002 (JP) ..... 2002-012212

(51) Int. Cl.
*C25D 11/02* (2006.01)
*C25D 17/00* (2006.01)

(52) U.S. Cl. ..... 205/91; 204/223; 204/230.2; 204/DIG. 7; 205/96; 205/157; 205/316; 205/324

(58) Field of Classification Search ..... 205/91, 205/96, 157, 316, 324; 204/230.2, 223, DIG. 7
See application file for complete search history.

(56) References Cited

U.S. PATENT DOCUMENTS 4,507,181 A * 3/1985 Nath et al. ..... 205/91

(Continued)

FOREIGN PATENT DOCUMENTS

JP 05-063075 3/1993

(Continued)

*Primary Examiner*—Roy King
*Assistant Examiner*—William T. Leader
(74) *Attorney, Agent, or Firm*—Crowell & Moring LLP

(57) ABSTRACT

In an anodization apparatus and an anodization method for electrochemically treating a target substrate by irradiating the target substrate with light, treatment of a large target substrate can be made possible with smaller constituent elements. The electrical contact with the target substrate by a contact member is realized by a plurality of contact members or by the movement of a contact member to change the electrical contact position. The target substrate is manufactured in advance so as to have such a structure that portions thereof to be in contact with the plural contact members are connected to portions of a conductive layer on a treatment part thereof respectively. When the combination of this target substrate and the contact member(s) is used, and the electric current is passed through a part of the contact members, using a changeover switch, or the electric current passed through the contact member is applied to a portion of the conductive layer of the target substrate by the movement of the contact member, it is made possible to reduce the value of the electric current necessary for the treatment to an amount required only for the portion of the treatment part.

16 Claims, 6 Drawing Sheets

U.S. PATENT DOCUMENTS

| | | | | |
|---|---|---|---|---|
| 6,187,164 | B1 * | 2/2001 | Warren et al. | 205/81 |
| 6,402,925 | B2 * | 6/2002 | Talieh | 205/222 |
| 6,500,325 | B2 * | 12/2002 | Kosaki et al. | 205/96 |

FOREIGN PATENT DOCUMENTS

| | | |
|---|---|---|
| JP | 5063075 | 3/1993 |
| JP | 08-087956 | 4/1996 |
| JP | 8087956 | 4/1996 |
| JP | 2000-100316 | 4/2000 |
| JP | 2000-164115 | 6/2000 |
| JP | 2001-283197 | 10/2001 |
| JP | 2001-343020 | 12/2001 |

* cited by examiner

ANODIZATION DEVICE AND ANODIZATION METHOD

TECHNICAL FIELD

The present invention relates to an anodization apparatus and an anodization method for electrochemically treating a target substrate which is an anode, more particularly, to the anodization apparatus and the anodization method suitable for treating a large target substrate.

BACKGROUND ART

Electrochemical anodization of target substrates is in use on various scenes. Such anodization includes treatment in which a polycrystalline silicon layer is made porous. The outline thereof is such that the target substrate having the polycrystalline silicon layer formed on the surface thereof is electrically connected to a positive potential pole of a power supply via a conductor and immersed in a hydrofluoric acid solution dissolved in a solvent (for example, ethyl alcohol). An electrode made of, for example, platinum is immersed in the hydrofluoric acid solution, in other words, in a chemical, and is electrically connected to a negative potential pole of the above-mentioned power supply. Further, the polycrystalline silicon layer on the target substrate immersed in the chemical is irradiated with light by a lamp.

This causes the polycrystalline silicon layer to partly melt in the hydrofluoric acid solution. Pores are formed where the polycrystalline silicon layer has been melted, so that the silicon layer is turned into a porous structure. The photoirradiation by the lamp is intended for producing holes necessary for the reaction of the above-mentioned melting and pore formation in the polycrystalline silicon layer. For reference, such reaction in the polycrystalline silicon layer in the anodization is explained, for example, as follows.

$$Si+2HF+(2-n)e^{+}\rightarrow SiF_2+2H^{+}+ne^{-}$$

$$SiF_2+2HF\rightarrow SiF_4+H_2$$

$$SiF_4+2HF\rightarrow H_2SiF_6$$

Here, $e^{+}$ is a hole and $e^{-}$ is an electron. Therefore, this reaction requires holes as a precondition and is different from simple electrolytic polishing.

The porous silicon thus produced is made suitable as a highly efficient field emission electron source by further forming a silicon oxide layer on a nano-level surface thereof, which is disclosed in, for example, Japanese Patent Laid-open No. 2000-164115, Japanese Patent Laid-open No. 2000-100316, and so on. The use of such porous silicon as the field emission electron source has been drawing attention as opening a door to realizing a new flat display device.

In the anodization as described above, a value of an electric current flowing to a cathode electrode through a chemical from the target substrate is proportional to the area of the target substrate (the area of a treatment part). This is because the electric current promotes the reaction, and the reaction is caused uniformly on respective portions in the surface of the target substrate. Therefore, when the target substrate is intended for use in a large display device and thus has a large area, the value of the electric current necessary for the treatment remarkably increases. For example, assuming that a target substrate of 200 mm square requires a treatment current of about 5 A, an electric current of 100 A, which is 25 times as large, is required for a target substrate of 1000 mm square. Note that the area substantially equal to 1000 mm square is a commonly conceivable value from the viewpoint of the future trend of large display devices.

An apparatus to supply such a large electric current naturally has a large power supply section or the like, which makes the apparatus expensive. Further, the area of the photoirradiation by a light source is increased, and the shape of the cathode electrode becomes large, which also causes the cost increase of the apparatus. This is also reflected in the manufacturing cost of substrates manufactured by the apparatus.

Further, from a different viewpoint, there also exists a problem of deterioration in uniformity of the anodization in the surface of the target substrate because the increase in the area of the photoirradiation by the light source makes it difficult to achieve a uniform amount of photoirradiation of the target substrate and because the increase in the size of the cathode electrode makes it difficult to ensure uniformity of an electric field formed between the cathode electrode and the target substrate. This is problematic in ensuring quality of manufactured substrates.

DISCLOSURE OF THE INVENTION

The present invention is made in consideration of the above-mentioned circumstances, and an object thereof is to provide an anodization apparatus and an anodization method for electrochemically treating a target substrate which is an anode, more particularly, to the anodization apparatus and the anodization method that enable the treatment of a large target substrate with smaller constituent elements.

In order to solve the above-described problems, an anodization apparatus according to an aspect of the present invention includes: a lamp that emits light; a stage provided at a position reached by the emitted light and capable of having a target substrate placed thereon with a treatment part of the target substrate facing upward; a cathode electrode that is provided on the way of the emitted light to reach the placed target substrate and that has an opening portion to allow the light to pass therethrough and has a conductor section not transmitting the light; a frame that forms a treatment tank when connected to the stage and has an opening portion; a seal member provided on a face of the frame opposed to the target substrate so as to be in contact with the target substrate in a ring form when the frame is opposed to and comes close to the placed target substrate, thereby establishing liquid sealability between the frame and the target substrate; a plurality of conductive contact members provided outside the ring form of the seal member; and a unit to supply an electric current selectively to each of the plural contact members (claim 1).

In short, the electrical contact with the target substrate by the contact member is realized by the plural contact members. In order to make the target substrate compatible with this structure, the target substrate can be manufactured in advance so as to have such a structure that portions thereof to be in contact with the plural contact members (electrode pads) are connected to portions of a conductive layer (or conductor patterns, the same applies to the description below) of the treatment part thereof respectively. With the combination of such a target substrate and the plural contact members, an electric current passage only through a part of the contact members is realized by, for example, a changeover switch, so that it is possible to reduce the value of the electric current necessary for the treatment to an amount required by only a portion of the treatment part. When the respective portions are treated while the electric current passage through the contact members is changed over by, for example, the changeover switch, the whole surface of the treatment part can be anodized. This can reduce the capacity of a supply section of power required for the anodization, so that an apparatus capable of treating a large target substrate with smaller constituent elements can be obtained.

An anodization apparatus according to another aspect of the present invention includes: a lamp that emits light; a stage provided at a position reached by the emitted light and capable of having a target substrate placed thereon with a treatment part of the target substrate facing upward; a cathode electrode that is provided on the way of the emitted light to reach the placed target substrate and that has an opening portion to allow the light to pass therethrough and has a conductor section not transmitting the light; a frame that forms a treatment tank when connected to the stage and has an opening portion; a seal member provided on a face of the frame opposed to the target substrate so as to be in contact with the target substrate in a ring form when the frame is opposed to and comes close to the placed target substrate, thereby establishing liquid sealability between the frame and the target substrate; a conductive contact member provided outside the ring form of the seal member; and a contact moving mechanism to move the contact member outside the ring form of the seal member (claim 2).

In short, the electrical contact position of the contact member with the target substrate is shifted by the movement of the contact member. In order to make the target substrate compatible with this structure, the target substrate can be manufactured in advance so as to have such a structure that portions (a plurality of electrode pads) thereof to be in contact with the contact member are connected to portions of a conductive layer on the treatment part respectively. With the combination of such a target substrate and the contact member, the electric current passage through a portion of the conductive layer on the target substrate is realized by the movement of the contact member, which makes it possible to reduce the value of the electric current necessary for the treatment to an amount required by only a portion of the treatment part. When the respective portions are treated while the contact member is being moved, the entire face of the treatment part can be anodized. Therefore, the capacity of a supply section of power required for the anodization can be reduced, so that an apparatus capable of treating a large target substrate with smaller constituent elements can be obtained. Incidentally, depending on the arrangement of the plural electrode pads on the target substrate, continuous movement or stepping movement of the contact member can be adopted.

As a preferable embodiment form of the present invention, the anodization apparatus as set forth in claim 1 or claim 2 further includes a lamp moving mechanism to move the lamp in a direction substantially parallel to a face of the placed target substrate (claim 3). This enables uniform photoirradiation to a small area, targeted specifically at a portion, through which electric current is passed via the contact member for causing electrochemical reaction, of the treatment part of the target substrate.

As another preferable embodiment form of the present invention, the anodization apparatus as set forth in claim 1, 2, or 3 further includes a cathode electrode moving mechanism to move the cathode electrode in the direction substantially parallel to the face of the placed target substrate (claim 4). This makes it possible to have the cathode electrode face a small area, targeted only at a portion, through which the electric current is passed via the contact member for causing an electrochemical reaction, of the treatment part of the target substrate.

As still another preferable embodiment form of the present invention, the anodization apparatus as set forth in claim 3 further includes a lamp moving mechanism control section that is connected to the lamp moving mechanism and that controls the movement of the lamp by the lamp moving mechanism to be synchronized with shift of a portion, from which an electric field is generated by the contact member, on the target substrate (claim 5). The movement of the lamp at the time of the photoirradiation to the portion, through which the electric current is passed via the contact member for causing the electrochemical reaction, of the treatment part of the target substrate, is automatically synchronized with the shift of this portion. Incidentally, depending on how the electric current passage through the electrode pads of the target substrate is changed over, continuous movement of the lamp or stepping movement of the lamp can be adopted.

As yet another preferable embodiment form of the present invention, the anodization apparatus as set forth in claim 4 further includes a cathode electrode moving mechanism control section that is connected to the cathode electrode moving mechanism and that controls the movement of the cathode electrode by the cathode electrode moving mechanism to be synchronized with shift of a portion, from which an electric field is generated by the contact member, on the target substrate (claim 6). The movement of the cathode electrode when the cathode electrode is made to face the portion, through which the electric current is passed via the contact member for causing the electrochemical reaction, of the treatment part of the target substrate is automatically synchronized with the shift of this portion. Incidentally, depending on how the electric current passage through the electrode pads of the target substrate is changed over, continuous movement of the cathode electrode or stepping movement of the cathode electrode can be adopted.

An anodization method according to an aspect of the present invention is characterized in that it includes: placing a target substrate on a stage with a treatment part of the target substrate facing upward; bringing a frame into contact with the placed target substrate, the frame having a face opposed to the placed target substrate, an opening portion to expose the treatment part of the placed target substrate upward, and a seal member provided in a ring form on the opposed face, and establishing liquid sealability between the frame and the target substrate by the seal member, to thereby forming a treatment tank inside the frame with the treatment part serving as a bottom portion; supplying a chemical into the formed treatment tank and placing a cathode electrode in the supplied chemical; passing a driving electric current between a part of plural electrode pads provided on a peripheral edge of the target substrate sealed by the seal member and the cathode electrode placed in the chemical; and irradiating the treatment part brought into contact with the chemical with light, and that the passage of the driving electric current is repeated a plurality of times in sequence with the part of the plural electrode pads being replaced by another part (claim 7).

In short, according to this method, the value of the electric current necessary for the treatment can be reduced to an amount required only for a portion of the treatment part, similarly to the operation explained in claim 1 or 2. Therefore, the capacity of a supply section of power necessary for the anodization can be reduced, so that a method capable of treating a large target substrate with smaller constituent elements can be obtained. Incidentally, a conductive layer on the target substrate may be a patterned one, and can use, for example, aluminum as the material thereof.

As a preferable embodiment form of the present invention, in the anodization method as set forth in claim 7, in the irradiation of the target substrate with light, the light is emitted so as to be aligned with a portion, from which an electric field is generated by the passage of the driving electric current, of the treatment part on the target substrate (claim 8). This enables uniform photoirradiation to a small area, targeted only at a portion, through which an electric current is passed for causing electrochemical reaction, of the treatment part of the target substrate. Incidentally, depending on how the electric current passage through the electrode pads of the target substrate is changed over, continuous movement of the lamp or stepping movement of the lamp can be adopted.

As a preferable embodiment form of the present invention, in the anodization method as set forth in claim 7 or 8, in the passage of the driving electric current, the position of the cathode electrode is moved in synchronization with shift of the portion, from which the electric field is generated, of the treatment part on the target substrate, the shift of the portion being caused in accordance with the replacement of the part of the plural electrode pads by another part (claim 9). This enables the cathode electrode to face a small area, targeted only at a portion, through which the electric current is passed for causing the electrochemical reaction, of the treatment part of the target substrate. Incidentally, continuous movement of the cathode electrode or stepping movement of the cathode electrode can be adopted, depending on how the electric current passage through the electrode pads of the target substrate is changed over.

Incidentally, the anodization apparatus and the anodization method of the present invention described above are also adoptable as a typical anodic oxidation apparatus and a method thereof not requiring photoirradiation as a structure realizing the downsizing of the constituent elements of the apparatus.

Specifically, the apparatus as mentioned above is an anodization apparatus including: a stage capable of having a target substrate placed thereon with a treatment part of the target substrate facing upward; a cathode electrode facing the placed target substrate; a frame that forms a treatment tank when connected to the stage and has an opening portion; a seal member provided on a face of the frame opposed to the target substrate so as to be in contact with the target substrate in a ring form when the frame is opposed to and comes close to the placed target substrate, thereby establishing liquid sealability between the frame and the target substrate; a plurality of conductive contact members provided outside the ring form of the seal member; and a unit to supply an electric current selectively to each of the plural contact members.

Further, the anodization apparatus as mentioned above is an anodization apparatus including: a stage capable of having a target substrate placed thereon with a treatment part of the target substrate facing upward; a cathode electrode facing the placed target substrate; a frame that forms a treatment tank when connected to the stage and has an opening portion; a seal member that is provided on a face of the frame opposed to the target substrate so as to be in contact with the target substrate in a ring form when the frame is opposed to and comes close to the placed target substrate, thereby establishing liquid sealability between the frame and the target substrate; a conductive contact member provided outside the ring form of the seal member; and a contact moving mechanism to move the contact member outside the ring form of the seal member.

Further, this anodization apparatus may further include a cathode electrode moving mechanism to move the cathode electrode in a direction substantially parallel to a face of the placed target substrate.

Moreover, this anodization apparatus may further include a cathode electrode moving mechanism control section that is connected to the cathode electrode moving mechanism and that controls the movement of the cathode electrode by the cathode electrode moving mechanism to be synchronized with shift of a portion, from which an electric field is generated by the contact member, on the target substrate.

The anodization method as mentioned above is an anodization method including: placing a target substrate on a stage with a treatment part of the target substrate facing upward; bringing a frame into contact with the placed target substrate, the frame having a face opposed to the placed target substrate, an opening portion to expose the treatment part of the placed target substrate upward, and a seal member provided in a ring form on the opposed face, and establishing liquid sealability between the frame and the target substrate by the seal member, to thereby forming a treatment tank inside the frame with the treatment part serving as a bottom portion; supplying a chemical into the formed treatment tank and placing a cathode electrode in the supplied chemical; and passing a driving electric current between a part of plural electrode pads provided on a peripheral edge of the target substrate sealed by the seal member and the cathode electrode placed in the chemical, the passage of the driving electric current being repeated a plurality of times in sequence with the part of the plural electrode pads being replaced by another part.

Here, in the passage of the diving electric current, the position of the cathode electrode may be moved in synchronization with shift of the portion, from which an electric field is generated, of the treatment part on the target substrate, the shift of the portion being caused by the replacement of the part of the plural electrode pads by another part.

BEST MODE FOR CARRYING OUT THE INVENTION

According to an embodiment of the present invention, the electrical contact with a target substrate by a contact member is realized by a plurality of contact members, and in order to make the target substrate compatible with this structure, the target substrate is manufactured in advance so as to have such a structure that portions (electrode pads) thereof to be in contact with the plural contact members are connected to portions of a conductive layer on the treatment part respectively. With the combination of such a target substrate and the plural contact members, an electric current passage only through a part of the contact members is realized by, for example, a changeover switch, so that it is possible to reduce the value of the electric current necessary for the treatment to an amount required by only a portion of the treatment part. This can reduce the capacity of a supply section of power required for the anodization, so that an apparatus capable of treating a large target substrate with smaller constituent elements can be obtained.

According to another embodiment of the present invention, the position of the electrical contact of a contact member with a target substrate is shifted by the movement of the contact member, and in order to make the target substrate compatible with this structure, the target substrate is manufactured in advance so as to have such a structure that portions thereof (a plurality of electrode pads) to be in contact with the contact member are connected to portions of a conductive layer on the treatment part respectively. With the combination of such a target substrate and the contact member, the electric current is passed through each portion of a conductive layer of the target substrate by the movement of the contact member, which makes it possible to reduce the value of the electric current necessary for the treatment to an amount required by only a portion of the treatment part. Therefore, the capacity of a supply section of power required for the anodization can be reduced, so that an apparatus capable of treating a large target substrate with smaller constituent elements is obtainable.

Hereinafter, embodiments of the present invention will be explained with reference to the drawings.

Figure 1A:
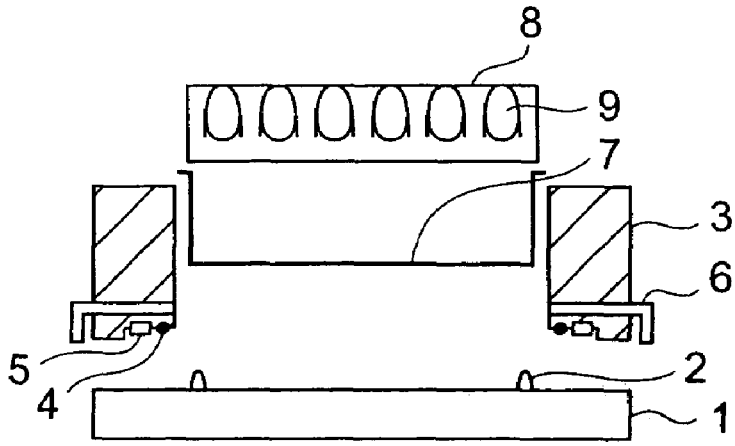
FIG. 1A, FIG. 1B, and FIG. 1C are vertical sectional views schematically showing the basic structure of an anodization apparatus according to an embodiment of the present invention in the order of the operation procedure.
Figure 1B:
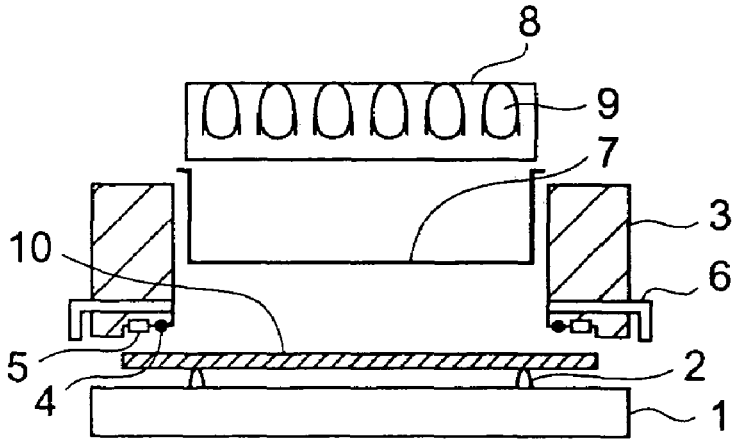
Figure 1C:
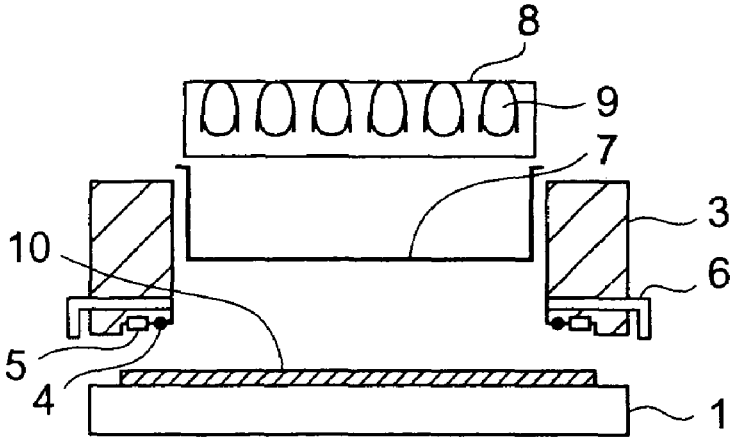
Figure 2A:
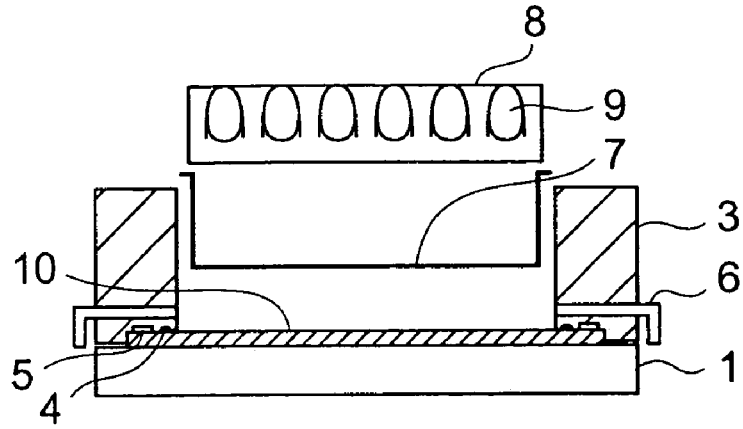
FIG. 2A, FIG. 2B, and FIG. 2C, which are continued from FIG. 1C, are vertical sectional views schematically showing the basic structure of the anodization apparatus according to the embodiment of the present invention in the order of the operation procedure.
Figure 2B:
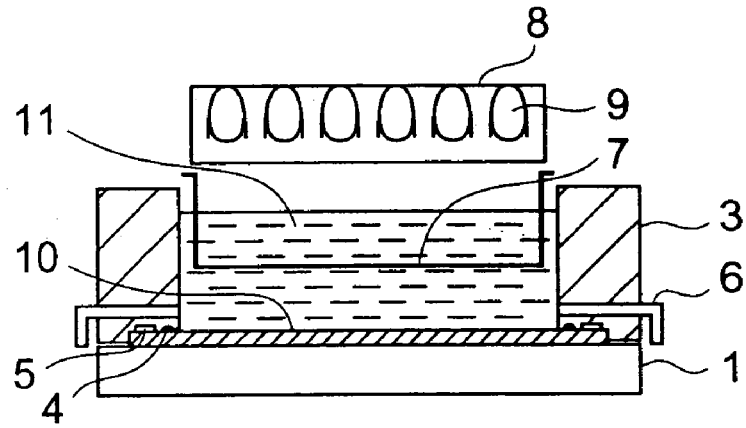
Figure 2C:
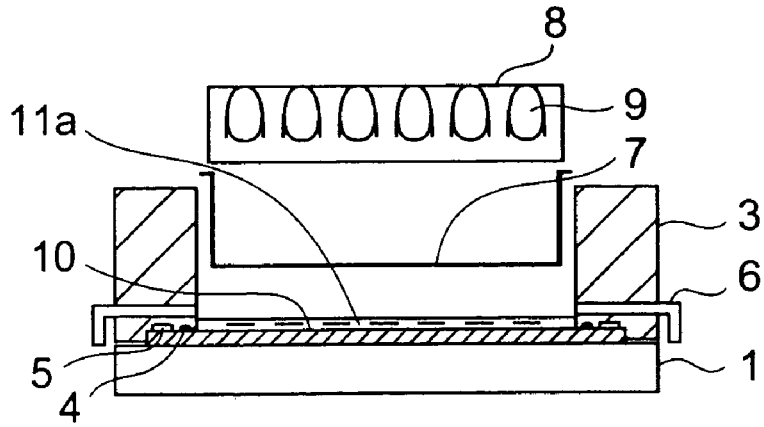

FIG. 1A, FIG. 1B, and FIG. 1C are vertical sectional views schematically showing the basic structure of an anodization apparatus according to an embodiment of the present invention and these drawings show that the operation proceeds in the order of FIG. 1A to FIG. 1C. FIG. 2A, FIG. 2B, and FIG. 2C, which are continued from FIG. 1C, similarly show that the operation proceeds in the order of FIG. 2A to FIG. 2C.

As shown in FIG. 1A, this anodization apparatus includes a stage 1, a substrate lifter 2 provided on the stage 1, a frame 3, a seal member 4 and contact members 5 provided on the frame 3, a chemical supply/discharge port 6 passing through the frame 3, a cathode electrode 7, a lamp unit 8, and lamps 9 provided in the lamp unit 8.

The stage 1, which is a table on which the target substrate can be placed with a treatment part thereof facing upward, has the substrate lifter 2 intended for smoothly delivering and taking out the target substrate. The substrate lifter 2, which is provided to be capable of protruding from and setting under an upper face of the stage 1, protrudes from the upper face of the stage 1 when the target substrate is delivered to and taken out of the stage 1. By such protrusion of the substrate lifter 2, a gap is made between the upper face of the stage 1 and the target substrate, which enables the smooth operation of, for example, an arm robot having a fork horizontally supporting the target substrate when the target substrate is delivered from and taken out of the stage 1.

The frame 3 has a face opposed to a peripheral edge of the target substrate placed on the stage 1, and has a cylindrical shape having an opening portion to expose the treatment part of the target substrate upward. In the state shown in FIG. 1A, there exists a gap between the stage 1 and the frame 3, but when the target substrate is placed on the stage 1, a not-shown vertically moving mechanism lowers the frame 3 relatively to the target substrate. Here, the term relatively is used in order to indicate that the stage 1 side may be lifted.

When the frame 3 is lowered relatively to the target substrate, the seal member 4 provided in a ring form on a bottom face of the frame 3 comes into contact with the target substrate and is pressed down, so that liquid sealability is established. In other words, a treatment tank can be formed inside the frame 3 with the treatment part of the target substrate serving as a bottom face.

A plurality of conductive contact members 5 are provided outside the ring form of the seal member 3. When the above-mentioned sealability is established, the contact members 5 come in electrical contact with electrode pads provided on the peripheral edge of the target substrate in a dry state and this state is maintained by the seal member 3 even after a chemical is filled in the treatment tank.

Further, the chemical supply/discharge port 6 is provided to pass through a wall of the frame 3. When the treatment tank with the treatment part of the target substrate serving as the bottom face is formed inside the frame 3 as described above, the chemical used for anodization can be supplied through the chemical supply/discharge port. The chemical is supplied to the inside of the frame 3, an amount thereof being large enough for a horizontal portion of the cathode electrode 7 to be immersed in the chemical.

The cathode electrode 7 is supported by a supporting member (not shown) so as to be kept perpendicular relatively to the frame 3. The cathode electrode 7 is in a plane shape facing substantially parallel to the treatment part of the target substrate, and has opening portions allowing light from the lamp 9 to pass therethrough and a conductor section made of a material enabling the cathode electrode to function as an electrode. The conductor section is, for example, in a lattice form. During actual anodization, a driving electric current is passed between the cathode electrode 7 and the plural contact members 5, the driving electric current being passed through parts of the contact members 5 in sequence by a not-shown current source. The current source to thus supply the driving electric current in sequence will be described later.

The lamp unit 8 has the plural lamps 9 and is so disposed that light emitted therefrom is pointed at the target substrate placed on the stage 1. Further, a supporting member (not shown) supports the lamp unit 8 so as to keep the lamp unit 8 perpendicular relatively to the frame 3.

The operations of processes for treating the target substrate by this anodization apparatus having the structure explained above will be explained using FIG. 1A to FIG. 1C and FIG. 2A to FIG. 2C.

First, the state in which a target substrate can be received is produced as the state shown in FIG. 1A (the state in which the substrate lifter 2 protrudes from the upper face of the stage 1 and the gap exists between the frame 3 and the stage 1). Then, a target substrate 10 is carried in through the gap between the frame 3 and the stage 1 by, for example, an arm robot having a fork and delivered onto the substrate lifter 2 as shown in FIG. 1B.

Next, as shown in FIG. 1C, the substrate lifer 2 is made to set into the stage 1 and the target substrate 10 is placed and held on the stage 1. When the target substrate 10 is placed and held on the stage 1, the frame 3 (and the cathode electrode 7 and the lamp unit 8) is lowered relatively to the stage 1 as shown in FIG. 2A to bring the seal member 4 pressingly into contact with the target substrate 10. At this time, the plural contact members 5 come into electrical contact with the electrode pads provided on the peripheral edge of the target substrate 10. Further, the treatment tank with the treatment part of the target substrate 10 serving as the bottom portion is formed inside the frame 3.

Next, the chemical (for example, a hydrofluoric acid solution with ethyl alcohol being a solvent) 11 is supplied into the treatment tank through the chemical supply/discharge port 6, and the chemical in an amount large enough for the cathode electrode 7 to be immersed therein is filled as shown in FIG. 2B. When this state is produced, actual anodization can be conducted. The anodization is conducted in such a manner that a driving electric current is passed between the plural contact members 5 and the cathode electrode 7, the driving electric current being passed through parts of the contact members 5 in sequence, and the lamp 9 is turned on to irradiate the treatment part of the target substrate 10 with light. The treatment time is about several seconds to about several ten seconds for each part of the contact members 5.

When the actual anodization is finished, the chemical 11 is discharged through the chemical supply/discharge port 6 as shown in FIG. 2C. Thereafter, the inside of the treatment tank and the treatment part of the target substrate 10 may be washed by supplying and discharging, for example, ethyl alcohol for dilution several times through the chemical supply/discharge port 6. The discharge to such an extent to make the level of a residual solution 11*a* exist above the target substrate 10 can prevent the treatment part from being given an adverse effect from the atmosphere.

Figure 3:
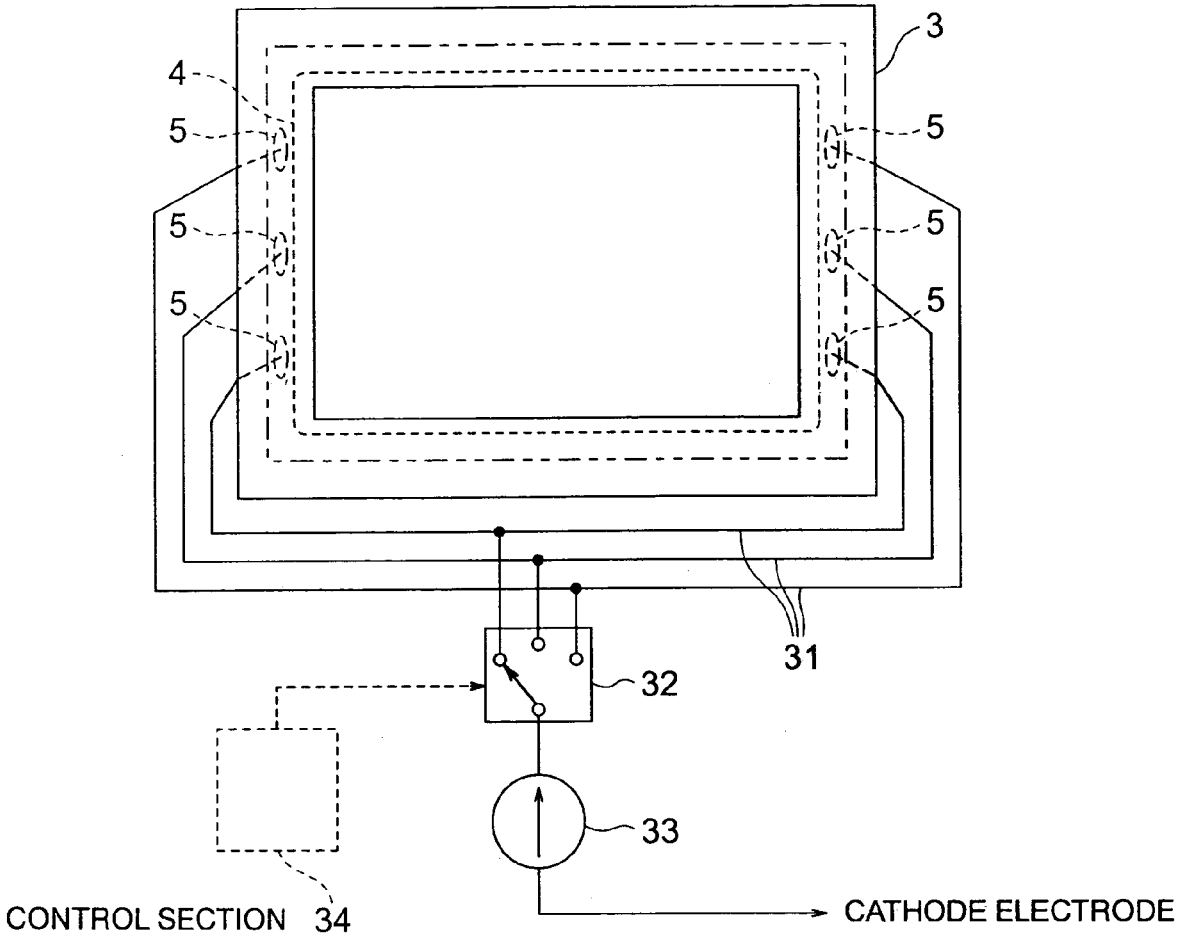
FIG. 3 is a plan view of a frame 3 shown in FIG. 1A, FIG. 1B, FIG. 1C, FIG. 2A, FIG. 2B, and FIG. 2C and a view showing the electrical connection relationship from contact members 5 to a current source 33.

Next, the structure in which the driving electric current is passed through each part of the contact members 5 in sequence explained above will be explained in more detail with reference to FIG. 3. FIG. 3 is a plan view of the frame 3 and is a view showing the electrical connection relationship from the contact members 5 to a current source 33, in which the same reference numerals are used to designate the constituent elements already explained. Note that the chemical supply/discharge port 6 is omitted in the drawing for the convenience of the explanation.

As shown in the drawing, the seal member 4 is provided in a ring form on the bottom face (face opposed to the target substrate) of the frame 3, and the plural contact members 5 are provided outside the ring form thereof. Note that the frame shown by the chain double-dashed line shows the position in which the target substrate 10 is to be disposed. The plural contact members 5 are provided in three pairs at positions corresponding to positions adjacent to two opposed sides of the target substrate 10 in this embodiment.

The contact members 5 opposed to each other to make each pair are electrically connected to each other by each of lead wires 31, and the respective pairs are further connected to separate switching terminals of a changeover switch 32. A common terminal of the changeover switch 32 is connected to a positive pole side of the current source 33. A negative pole side of the current source 33 is connected to the cathode electrode which is not shown in this drawing.

In such a structure, the changeover of the changeover switch 32 in sequence makes it possible to pass the driving electric current through the pairs of the contact members 5 in sequence. Specifically, when the changeover switch 32 is at the changeover position shown in the drawing, the driving electric current flows between the cathode electrode and the pair of the contact members 5 at the lowest position among the contact members 5. Similarly, when the changeover switch 32 is at the middle changeover position, the driving electric current flows between the cathode electrode and the pair of the contact members 5 positioned in the middle among the contact members 5, and when the changeover switch 32 is at the right changeover position, the driving electric current flows between the cathode electrode and the pair of the contact members 5 at the highest position among the contact members 5.

Note that automatic changeover of the driving electric current passage in sequence is made possible when a control section 34 is provided. As the control section 34, usable is, for example, a processing device having hardware such as a CPU (central processing unit) and software such as basic software and application programs.

Figure 4:
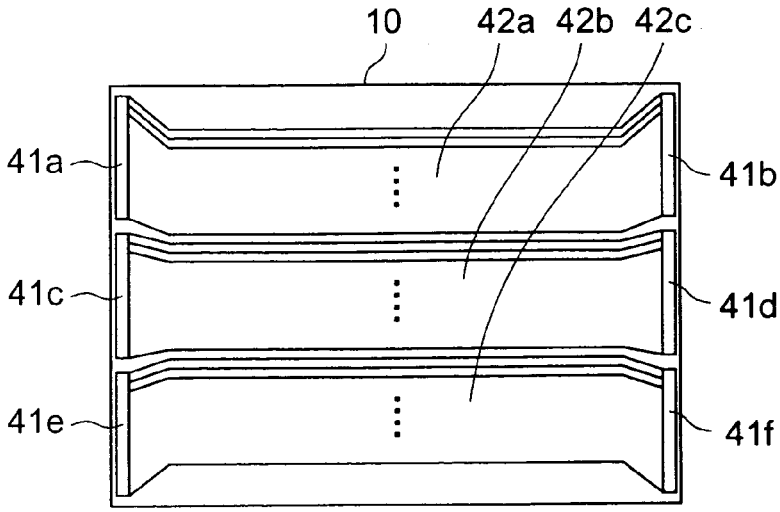
FIG. 4 is a plan view showing a structure example of a target substrate 10 shown in FIG. 1A, FIG. 1B, FIG. 1C, FIG. 2A, FIG. 2B, and FIG. 2C.

FIG. 4 is a plan view showing a structure example of the target substrate 10. As shown in this drawing, the target substrate 10 is so structured that conductor patterns 42*a*, 42*b*, 42*c* are each formed in a large number on, for example, a glass substrate in the horizontal direction in the drawing. Both ends of the conductor patterns 42*a*, 42*b*, 42*c* are connected to electrode pads 41*a*, 41*b*, electrode pads 41*c*, 41*d*, and electrode pads 41*e*, 41*f* in a bundle respectively. Note that polycrystalline silicon layers, though not shown, are formed on the conductor patterns 42*a*, 42*b*, 42*c*.

When such a target substrate 10 is applied to the anodization apparatus of this embodiment having the contact members 5 shown in FIG. 3, the electric current to the conductor patterns 42*a*, 42*b*, 42*c* is first passed through the conductor patterns 42*c*, subsequently through the conductor patterns 42*b*, and lastly through the conductor patterns 42*a*. In other words, the electric current is not passed through the conductor patterns 42*a*, 42*b*, 42*c* formed in the treatment part synchronously but is passed through the respective portions in sequence.

Therefore, the value of the electric current necessary for the treatment can be reduced to an amount required only for a portion of the treatment part. Then, when the respective portions are treated while the electric current passage through the contact members 5 is changed over by the aforesaid changeover switch 32, the entire surface of the treatment part can be anodized. Therefore, it is possible to reduce the capacity of the current source 33 necessary for the anodization, so that an apparatus capable of treating a large target substrate with smaller constituent elements is obtainable. Further, the area, through which the electric current is passed, on the target substrate 10 is reduced when each portion of the target substrate 10 is seen, so that improved uniformity of the electric current in the target substrate 10 can be expected. This can increase uniformity of the anodization.

Incidentally, in the above explanation, three pairs of the contact members 5 are provided, and accordingly, the conductor patterns of the target substrate 10 are connected to the electrode pads, being also divided into three portions, but the same effect can be brought about by a structure that the number of the provided contact members 5 is a plural number equal to two or more and the plural number of electrode pads are accordingly provided in the target substrate 10.

Figure 5A:
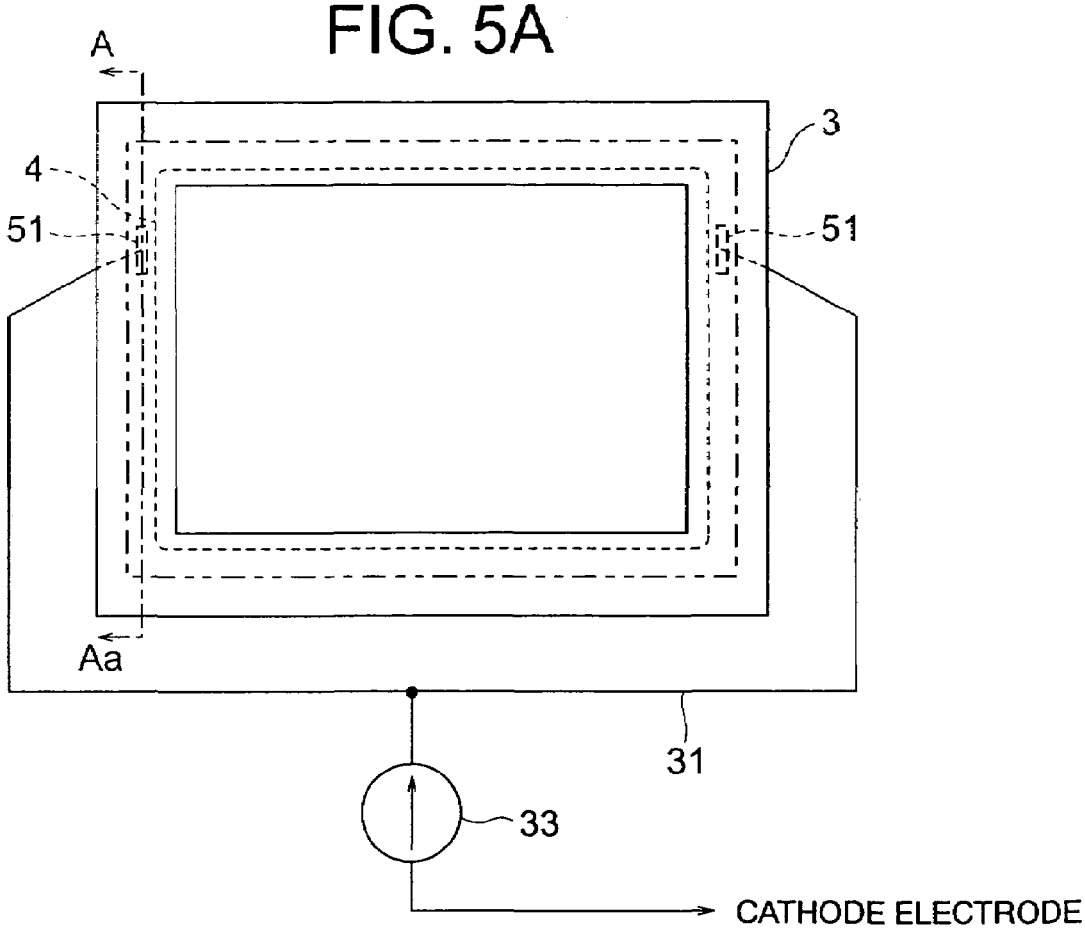
FIG. 5A is a plan view of the frame 3 shown in FIG. 1A, FIG. 1B, FIG. 1C, FIG. 2A, FIG. 2B, and FIG. 2C and a view showing the electrical connection relationship from contact members 51 to the current source 33.
Figure 5B:
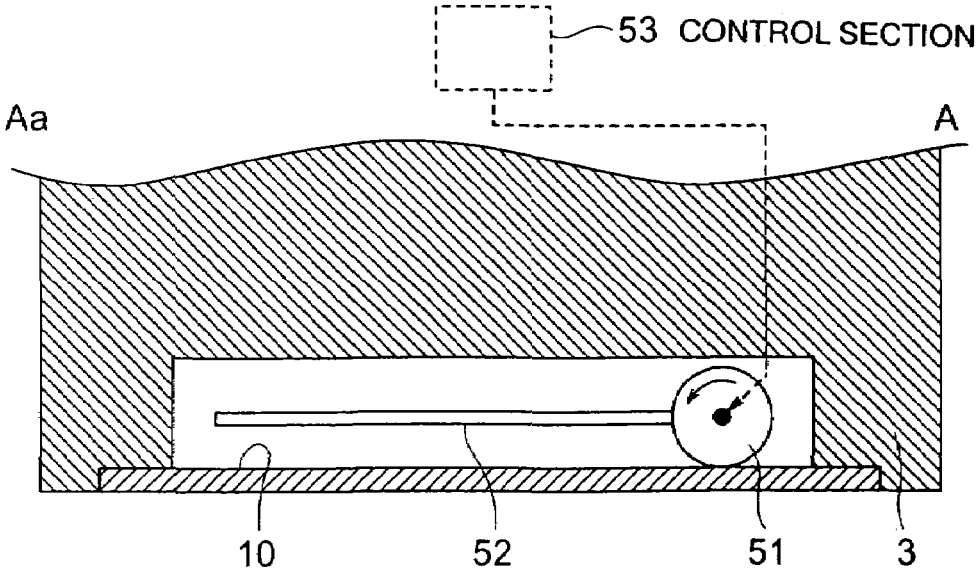
FIG. 5B is a fragmentary sectional view of the frame 3 shown in FIG. 1A, FIG. 1B, FIG. 1C, FIG. 2A, FIG. 2B, and FIG. 2C, both FIG. 5A and FIG. 5B showing different ones from those shown in FIG. 3 respectively.

Next, an embodiment different from the embodiment shown in FIG. 1A, FIG. 1B, and FIG. 1C to FIG. 3 will be explained with reference to FIG. 5A and FIG. 5B. FIG. 5A and FIG. 5B are views showing a part corresponding to the plan view of the frame 3 and the view showing the electrical connection relationship from the contact members to the current source 33, which are shown in FIG. 3. Views corresponding to FIG. 1A, FIG. 1B, FIG. 1C, FIG. 2A, FIG. 2B, and FIG. 2C are substantially the same except that the contact members 5 are different, and therefore, the explanation thereof will be omitted.

As shown in FIG. 5A, a pair of contact members 51 is provided in place of the contact members 5 in a frame 3 in this embodiment. The contact members 51 in this pair are electrically connected to each other by a lead wire 31 and further connected to a positive pole side of a current source 33. A negative pole side of the current source 33 is connected to a cathode electrode which is omitted in this drawing.

FIG. 5B is a cross sectional view taken along the A–Aa line in FIG. 5A. As shown in FIG. 5B, the contact member 51 is formed in a wheel shape, and is so disposed that a shaft thereof protrudes into a guide mechanism 52 as a contact moving mechanism provided in the frame 3. The contact member 51 moves along the peripheral edge of the target substrate 10 while being rotated by a not-shown rotating mechanism, which makes it possible for the contact member 51 to shift its contact position with the target substrate 10.

Therefore, the positional change of the contact member 51 makes it possible to pass an electric current through each of conductor patterns 41*a*, 42*b*, 42*c* formed on a treatment part in sequence, not synchronously, through the use of the target substrate 10 as shown in FIG. 4. Consequently, the value of the electric current necessary for the treatment can be reduced to an amount required only for a portion of the treatment part. Further, when respective portions of the treatment part are treated while the contact member 51 rotates on the peripheral edge of the target substrate 10 to shift its contact position, the entire surface of the treatment part can be anodized. Therefore, the capacity of the current source 33 necessary for the anodization can be reduced, so that it is possible to obtain an apparatus capable of treating a large target substrate with smaller constituent elements.

Note that such rotation and movement of the contact members 51 can be automatically caused in sequence by providing a control section 53 to control the rotating mechanism. As the control section 53, usable is, for example, a processing device having hardware such as a CPU and software such as basic software and application programs. As for the shape of the contact members 51 and a moving mechanism thereof, those of various kinds are conceivable, not limited to the examples described above. For example, as for the shape, the shape of a regular triangle rounded a little, a shape of two wheels between which a conductive belt is hung, and so on are conceivable instead of a circular shape such as a wheel. As for the moving mechanism, an appropriate one can be selected according to the shape of the contact members.

Figure 6:
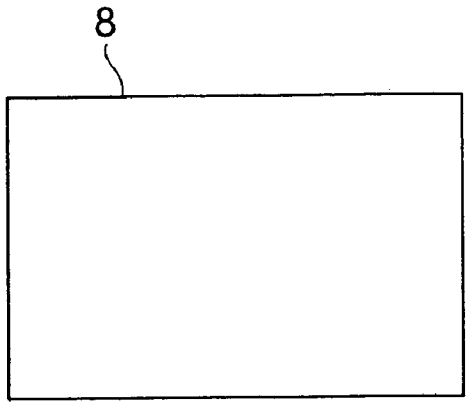
FIG. 6 is a plan view showing a lamp unit 8 shown in FIG. 1A, FIG. 1B, FIG. 1C, FIG. 2A, FIG. 2B, and FIG. 2C.

Next, the structure of the lamp unit 8 shown in FIG. 1A, FIG. 1B, FIG. 1C, FIG. 2A, FIG. 2B, and FIG. 2C will be further explained. FIG. 6 is a plan view showing the lamp unit 8 shown in FIG. 1A, FIG. 1B, FIG. 1C, FIG. 2A, FIG. 2B, and FIG. 2C. This lamp unit 8 has such a planar size and lamp arrangement that it can irradiate the entire space in the frame 3 with light at a time. As a mechanism, this lamp unit 8 can irradiate the treatment part of the target substrate 10 with light by a simple structure.

Figure 7:
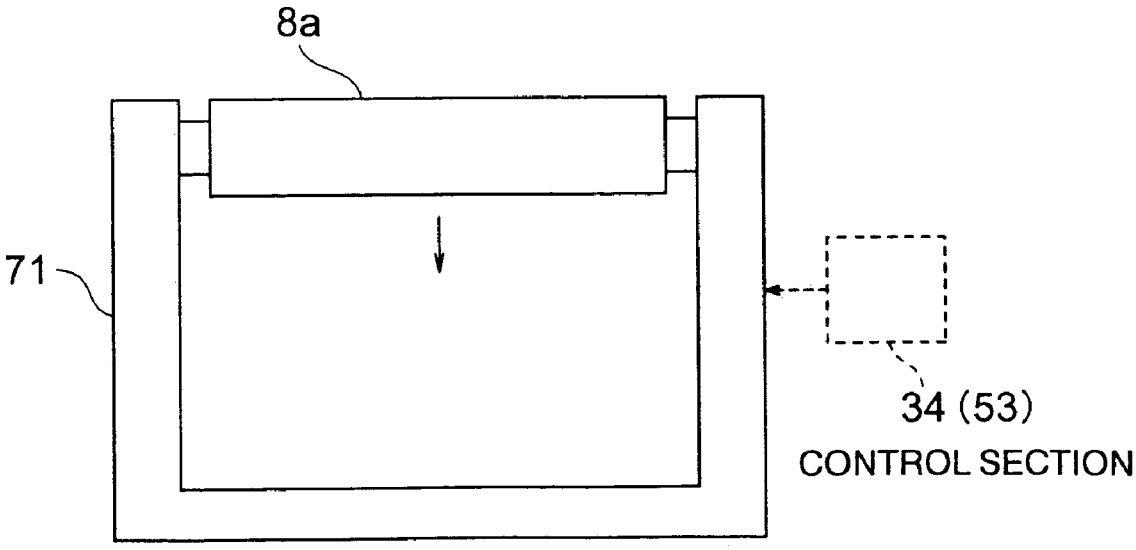
FIG. 7 is a plan view showing a lamp unit usable in place of the lamp unit 8 shown in FIG. 6 and the vicinity thereof.

FIG. 7 is a plan view of a lamp unit usable in place of the lamp unit 8 shown in FIG. 6 and the vicinity thereof. This lamp unit 8*a* is structured to be short in a vertical direction in the drawing so as to have an elongated irradiation area, and is supported by a lamp moving mechanism 71 to be movable in the vertical direction in the drawing.

The movement of the lamp unit 8*a* is synchronized with the shift of a portion, through which an electric current is passed, of the target substrate 10 irradiated with light. This enables the smaller lamp unit 8*a* to irradiate a portion on the target substrate 10 that is actually anodized with necessary light. Therefore, the number of lamps can be reduced, so that the reduction in the price of the apparatus can be expected. Moreover, irradiation nonuniformity can be reduced since the region to be irradiated with light has a small area, so that realization of more uniform anodization can be expected.

Incidentally, in order to synchronize the movement of the lamp unit 8*a* by the lamp moving mechanism 71 with the shift of the portion, through which the electric current is passed, in the irradiated target substrate 10, it is preferable that the movement of the lamp unit 8*a* by the lamp moving mechanism 71 is controlled by the control section 34 (or 53) already explained because the synchronization can be thereby established.

Figure 8:
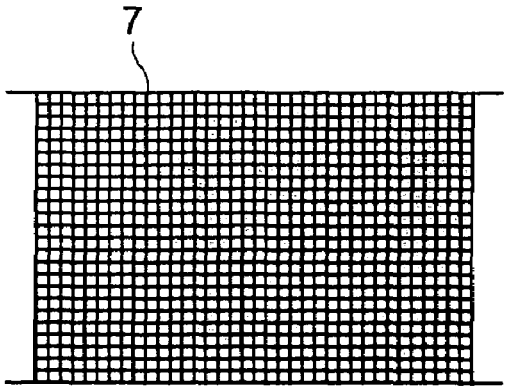
FIG. 8 is a plan view showing a cathode electrode 7 shown in FIG. 1A, FIG. 1B, FIG. 1C, FIG. 2A, FIG. 2B, and FIG. 2C.

Next, the structure of the cathode electrode 7 shown in FIG. 1A, FIG. 1B, FIG. 1C, FIG. 2A, FIG. 2B, and FIG. 2C will be further explained. FIG. 8 is a plan view showing the cathode electrode 7 shown in FIG. 1A, FIG. 1B, FIG. 1C, FIG. 2A, FIG. 2B, and FIG. 2C. This cathode electrode 7 has a planer size large enough to face the target substrate 10 in the whole inner space in the frame 3. Since it has no moving mechanism, it can have a simple structure.

Figure 9:
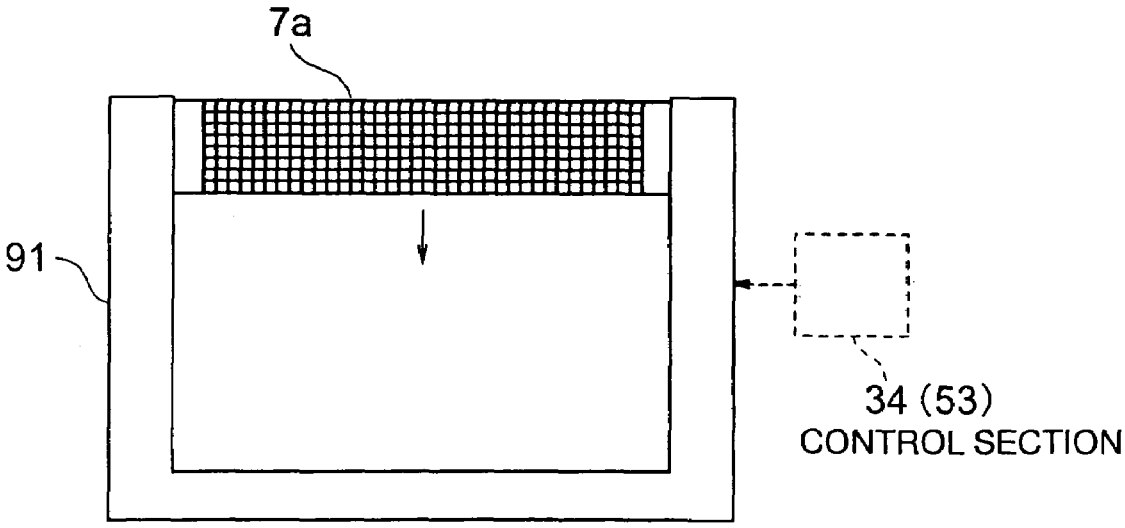
FIG. 9 is a plan view showing a cathode electrode usable in place of the cathode electrode 7 shown in FIG. 8 and the vicinity thereof.

FIG. 9 is a plan view showing a cathode electrode usable in place of the cathode electrode 7 shown in FIG. 8 and the vicinity thereof. This cathode electrode 7*a* is structured to be short in a vertical direction in the drawing and is supported by a cathode electrode moving mechanism 91 to be movable in the vertical direction in the drawing.

The movement of the cathode electrode 7*a* is synchronized with the shift of the portion, through which the electric current is passed, of the target substrate 10. This enables the use of the smaller cathode electrode 7*a* as the necessary cathode electrode facing the portion of the target substrate 10 that is actually anodized. Therefore, a usage amount of an expensive electrode material (for example, platinum) is reduced, so that it is possible to reduce the price as the apparatus. Further, the area facing the target substrate 10 of the cathode electrode 7*a* is reduced, so that more uniform generation of the electric field can be also expected. This can improve uniformity of the treatment.

Incidentally, in order to synchronize the movement of the cathode electrode 7*a* by the cathode electrode moving mechanism 91 with the shift of the portion, through which the electric current is passed, of the target substrate 10, it is preferable that the movement of the cathode electrode 7*a* by the cathode electrode moving mechanism 91 is controlled by the control section 34 (or 53) already explained because the synchronization can be thereby established. Moreover, the cathode electrode 7*a* is movably supported by the cathode electrode moving mechanism 91 in this example, but the cathode electrode 7*a* may be so structured that it is hung from the lamp unit 8*a* explained in FIG. 7 and the cathode electrode 7*a* and the lamp unit 8*a* are moved as one unit.

Further, the lamp moving mechanism 71 and the cathode electrode moving mechanism 91 shown in FIG. 7 and FIG. 9 respectively are mechanisms to move the lamp unit 8*a* and the cathode electrode 7*a* only in the vertical direction in the drawings, but in addition to this function, mechanisms having a function of moving them in a perpendicular direction to the drawing may be added. With such mechanisms, it is possible to position the lamp unit 8*a* and the cathode electrode 7*a* apart from the target substrate 10 with the most appropriate distance provided therebetween.

Incidentally, in the explanation given above, the anodization utilizing photoirradiation is taken as an example for explanation, but the effect of the downsizing of the constituent elements can be similarly obtained in the anodization not utilizing the photoirradiation.

INDUSTRIAL APPLICABILITY

An anodization apparatus according to the present invention can be produced in the manufacturing industry of flat display device (flat display panel) manufacturing equipment. It is also usable in the manufacturing industry of the flat display devices (flat display panels). An anodization method according to the present invention is usable in the manufacturing industry of the flat display devices (flat display panels). Therefore, both have industrial applicability.

What is claimed is:

1. An anodization apparatus comprising:

a lamp that emits light;

a stage provided at a position reached by the emitted light and capable of having a target substrate placed thereon with a treatment part of the target substrate facing upward;

a cathode electrode that is provided on a way of the emitted light to reach the placed target substrate and that has an opening portion to allow the light to pass therethrough and has a conductor section not transmitting the light;

a frame that forms a treatment tank when connected to said stage and has an opening portion;

a seal member provided on a face of said frame opposed to the target substrate so as to be in contact with the target substrate in a ring form when said frame is opposed to and comes close to the placed target substrate, thereby establishing liquid sealability between said frame and the target substrate;

a plurality of conductive contact members provided outside the ring form of said seal member; and a unit having a changeover switch and configured to supply an electric current to each of said plural contact members in sequence by a changeover of the changeover switch.

2. An anodization apparatus comprising:

a lamp that emits light;

a stage provided at a position reached by the emitted light and capable of having a target substrate placed thereon with a treatment part of the target substrate facing upward;

a cathode electrode that is provided on a way of the emitted light to reach the placed target substrate and that has an opening portion to allow the light to pass therethrough and has a conductor section not transmitting the light;

a frame that forms a treatment tank when connected to said stage and has an opening portion;

a seal member provided on a face of said frame opposed to the target substrate so as to be in contact with the target substrate in a ring form when said frame is opposed to and comes close to the placed target substrate, thereby establishing liquid sealability between said frame and the target substrate;

a conductive contact member capable of being moved, provided outside the ring form of said seal member; and a contact moving mechanism including a guide mechanism and configured to move said contact member along a peripheral edge of the target substrate by the guide mechanism so as to supply an electric current to a part of the target substrate in sequence.

3. An anodization apparatus as set forth in claim 1 or claim 2, further comprising a lamp moving mechanism configured to move said lamp in a direction substantially parallel to a face of the placed target substrate.

4. An anodization apparatus as set forth in any one of claims 1 or 2, further comprising a cathode electrode moving mechanism configured to move said cathode electrode in a direction substantially parallel to a face of the placed target substrate.

5. An anodization apparatus as set forth in claim 3, further comprising a lamp moving mechanism control section that is connected to said lamp moving mechanism and that controls a movement of said lamp by said lamp moving mechanism to be synchronized with shift of an electric field generating portion on the target substrate by said contact member.

6. An anodization apparatus as set forth in claim 4, further comprising a cathode electrode moving mechanism control section that is connected to said cathode electrode moving mechanism and that controls a movement of said cathode electrode by said cathode electrode moving mechanism to be synchronized with shift of an electric field generating portion on the target substrate by said contact member.

7. An anodization method comprising:

placing a target substrate on a stage with a treatment part of the target substrate facing upward;

bringing a frame into contact with the placed target substrate, the frame having a face opposed to the placed target substrate, an opening portion to expose the treatment part of the placed target substrate upward, and a seal member provided in a ring form on the opposed face, and establishing liquid sealability between the frame and the target substrate by the seal member, to thereby forming a treatment tank inside the frame with the treatment part serving as a bottom portion;

supplying a chemical into the formed treatment tank and placing a cathode electrode in the supplied chemical;

passing a driving electric current between a part of plural electrode pads provided on a peripheral edge of the target substrate sealed by the seal member and the cathode electrode placed in the chemical; and irradiating the treatment part brought into contact with the chemical with light, wherein said passage of the driving electric current is repeated a plurality of times in sequence with the part of the plural electrode pads being replaced with another part so as to change a current path within the target substrate.

8. An anodization method as set forth in claim 7, wherein, in said irradiation of the target substrate with light, the light is emitted so as to be aligned with shift of an electric field generating portion of the treatment part on the target substrate by said passage of the driving electric current.

9. An anodization method as set forth in claim 7 or claim 8, wherein, in said passage of the driving electric current, a position of the cathode electrode is moved in synchronization with shift of an electric field generating portion of the treatment part on the target substrate, the shift of the portion being caused in accordance with the replacement of the part of the plural electrode pads by another part.

10. An anodization apparatus comprising:

a stage capable of having a target substrate placed thereon with a treatment part of the target substrate facing upward;

a cathode electrode facing the placed target substrate;

a frame that forms a treatment tank when connected to said stage and has an opening portion;

a seal member provided on a face of said frame opposed to the target substrate so as to be in contact with the target substrate in a ring form when said frame is opposed to and comes close to the placed target substrate, thereby establishing liquid sealabiity between said frame and the target substrate;

a plurality of conductive contact members provided outside the ring form of said seal member; and a unit having a changeover switch and configured to supply an electric current to each of said plural contact members in sequence by a changeover of the changeover switch.

11. An anodization apparatus comprising:

a stage capable of having a target substrate placed thereon with a treatment part of the target substrate facing upward;

a cathode electrode facing the placed target substrate;

a frame that forms a treatment tank when connected to said stage and has an opening portion;

a seal member that is provided on a face of said frame opposed to the target substrate so as to be in contact with the target substrate in a ring form when said frame is opposed to and comes close to the placed target substrate, thereby establishing liquid sealability between said frame and the target substrate;

a conductive contact member capable of being moved, provided outside the ring form of said seal member; and a contact moving mechanism including a guide mechanism and configured to move said contact member along a peripheral edge of the target substrate by the guide mechanism so as to supply an electric current to a part of the target substrate in sequence.

12. An anodization apparatus according to claim 10 or claim 11, further comprising a cathode electrode moving mechanism configured to move said cathode electrode in a direction substantially parallel to a face of the placed target substrate.

13. An anodization apparatus as set forth in claim 12, further comprising a cathode electrode moving mechanism control section that is connected to said cathode electrode moving mechanism and that controls a movement of said cathode electrode by said cathode electrode moving mechanism to be synchronized with shift of an electric field generating portion on the target substrate by said contact member.

14. An anodization method comprising:

placing a target substrate on a stage with a treatment part of the target substrate facing upward;

bringing a frame into contact with the placed target substrate, the frame having a face opposed to the placed target substrate, an opening portion to expose the treatment part of the placed target substrate upward, and a seal member provided in a ring form on the opposed face, and establishing liquid sealability between the frame and the target substrate by the seal member, to thereby forming a treatment tank inside the frame with the treatment part serving as a bottom portion;

supplying a chemical into the formed treatment tank and placing a cathode electrode in the supplied chemical; and passing a driving electric current between a part of plural electrode pads provided on a peripheral edge of the target substrate sealed by the seal member and the cathode electrode placed in the chemical, wherein said passage of the driving electric current is repeated a plurality of times in sequence with the part of the plural electrode pads being replaced with another part so as to change a current path within the target substrate.

15. An anodization method as set forth in claim 14, wherein, in said passage of the diving electric current, a position of the cathode electrode is moved in synchronization with shift of an electric field generating portion of the treatment part on the target substrate, the shift of the portion being caused by the replacement of the part of the plural electrode pads by another part.

16. An anodization apparatus as set forth in claim 3, further comprising a cathode electrode moving mechanism configured to move said cathode electrode in the direction substantially parallel to the face of the placed target substrate.

* * * * *